United States Patent [19]

Federle et al.

[11] Patent Number: 4,848,370

[45] Date of Patent: Jul. 18, 1989

[54] METHOD FOR CONTROLLING AT LEAST TWO OF THE PHYSICAL PROPERTIES, DECISIVE FOR THE QUALITY OF THE FINISHED SMOKABLE ARTICLE, OF A MATERIAL ROD OF FILTER OR TABACCO MATERIAL

[75] Inventors: Hartmut Federle, Ahrensburg; Friedrich Walther, Bargteheide, both of Fed. Rep. of Germany

[73] Assignee: B.A.T. Cigarettenfabriken GmbH, Hamburg, Fed. Rep. of Germany

[21] Appl. No.: 171,717

[22] Filed: Mar. 22, 1988

[30] Foreign Application Priority Data

Apr. 2, 1987 [DE] Fed. Rep. of Germany ..... 3711142

[51] Int. Cl.[4] ..... A24C 5/14; A24C 5/31

[52] U.S. Cl. ..... 131/84.1; 131/84.4; 131/906; 131/908

[58] Field of Search ..... 131/906, 84.4, 84.1, 131/908

[56] References Cited

U.S. PATENT DOCUMENTS

| | | | |
|---|---|---|---|
| 3,999,134 | 12/1976 | Lorenzen | 131/908 X |
| 4,196,740 | 4/1980 | Rudszinat | 131/906 X |
| 4,284,087 | 8/1981 | Reuland | 131/906 X |
| 4,326,542 | 4/1982 | Lasglo et al. | 131/906 X |
| 4,548,215 | 10/1985 | Adebahr | 131/84.4 |
| 4,595,027 | 6/1986 | Higgins et al. | 131/906 X |
| 4,759,379 | 7/1988 | Lorenzen | 131/906 X |
| 4,766,910 | 8/1988 | Okumoto | 131/906 X |
| 4,771,794 | 9/1988 | Gaisser et al. | 131/84.1 |

FOREIGN PATENT DOCUMENTS

| | | |
|---|---|---|
| 0032399 | 7/1981 | European Pat. Off. . |
| 2208944 | 9/1973 | Fed. Rep. of Germany . |
| 2728797 | 1/1978 | Fed. Rep. of Germany . |
| 3306543 | 8/1984 | Fed. Rep. of Germany . |
| 3404635 | 8/1985 | Fed. Rep. of Germany . |
| 3613957 | 6/1987 | Fed. Rep. of Germany . |
| 3607244 | 9/1987 | Fed. Rep. of Germany . |

*Primary Examiner*—V. Millin
*Assistant Examiner*—Joe H. Cheng
*Attorney, Agent, or Firm*—Armstrong, Nikaido, Marmelstein, Kubovcik & Murray

[57] ABSTRACT

In a method for controlling at least two physical properties, decisive for the quality of the finished smokable article, of a material rod of filter or tobacco material for the manufacture of smokable articles, in particular in filter or cigarette manufacture, the actual values of said properties are detected, the respective differences between the actual and desired values are determined and from the differences determined control signals are obtained for actuating elements influencing the mass of the material making up the rod; to facilitate the generation of the desired values, the control is performed during start-up or when specific events occur by means of only a single primary product parameter. On reaching the desired value for this primary product parameter, the associated actual values for at least one other secondary product parameter are detected; and at least one of said actual values is used after calculation and evaluation as desired value for the then switched on or added control by means of said secondary product parameter.

5 Claims, 2 Drawing Sheets

METHOD FOR CONTROLLING AT LEAST TWO OF THE PHYSICAL PROPERTIES, DECISIVE FOR THE QUALITY OF THE FINISHED SMOKABLE ARTICLE, OF A MATERIAL ROD OF FILTER OR TABACCO MATERIAL

BACKGROUND OF THE INVENTION

1. Field of the Invention

The invention relates to a method for controlling at least two physical properties, decisive for the quality of the finished smokable article, of a material rod of filter or tobacco material for the production of smokable articles, particularly in the filter and cigarette industry.

2. Description of the Prior Art

Although similar problems occur with other smokable articles, the complexity of problems will be discussed only in conjunction with the manufacture of cigarettes.

In the manufacture of cigarettes various techniques are used to permit the continuous control of the physical properties of the rod of tobacco fibres during the cigarette manufacture and thus finally of the corresponding properties of the finished cigarette. It is, for example, known to determine the density of the rod important to the weight constancy of the cigarette and corresponding in turn to its weight, to compare the actual value determined with a reference or desired value and to control the formation of the rod in dependence upon the result of the comparison (German Offenlegungsschrift No. 22 08 944). For measuring the density, for example, the absorption of radiation in the rod of tobacco fibres can be employed, in particular beta radiation or microwaves. German Offenlegungsschrift No. 27 28 797 further discloses a method of manufacturing cigarette filters in which the draw resistance of the filter material or two is determined, compared with a desired value, and the result of the comparison is used for the filter tow supply; the tow supply is controlled so that the pressure drop across the measured tow remains substantially constant.

A further method is known from published European patent application No. 0 032 399, the humidity, mass, machine speed and the hardness of a rod of tobacco fibres being determined for the control; the measured hardness value is corrected by means of the other parameters, i.e. humidity, mass and machine speed, thus giving a corrected actual value which is compared with a desired value. Dependent on the result of this comparison, trimmer discs, which in the formation of the rod set a predetermined height of the tobacco rod, are adjusted.

Suitable sensors for detecting the harness of the tobacco rod are apparent from German Offenlegungsschrift No. 33 06 543 and German Offenlegungsschrift No. 34 04 635.

Finally, prior German patent application No. P 36 13 957.2-23 corresponding to U.S. Pat. No. 4,771,794 describes a method for controlling at least two physical properties, decisive for the quality of the finished product, of a rod made from smokable material, in particular in cigarette manufacture, wherein the actual values of said properties are detected, the particular differences between the actual values and the associated desired values are determined and finally from the determined differences control signals are obtained; these control signals are compared with each other so that the instantaneously largest control signal can be passed to a single actuating element for the mass flow of the smokable article. The control signals can be obtained from the hardness of the rod of smokable material, the draw resistance and/or the weight of the rod, and compared with each other.

This makes it possible to adjust the essential quality parameters of a smokable article, in a cigarette this is its draw resistance and hardness, very exactly to the optimum value and to rapidly recover the optimum state even with disturbances in operation.

In a rod-forming machine as used both for cigarette and filter manufacture a number of medium-term to long-term disturbances occur which can greatly influence the essential product and quality parameters, that is weight, hardness, draw resistance and diameter.

These disturbing influences include in a cigarette machine the humidity or moisture, the composition and the properties of the tobacco mixture as well as environmental influences, machine settings and the tolerance fluctuations due to the wear of machine parts, in particular format belt and format parts, and in a filter-making machine include the material properties of the filter material, as a rule cellulose acetate, the plasticizer content (content of triacetines) of the filter material and also the environmental influences, machine settings and wear of machine parts. The major environmental influences include the temperature and humidity whilst as main machine setting acount must be taken of the speed of rotation and thus the conveying speed.

In the regulation or control of the manufacture the actual values must, for example, be determined for the weight and/or the hardness and/or the draw resistance and/or the diameter by corresponding sensors and compared with predetermined desired values to bring the production finally to the optimum state.

However, this is problematical in that the individual parameters depend both on each other and on the disturbing influences explained above so that the adjusting of the particular desired values, in particular when starting the machine, is problematical.

SUMMARY OF THE INVENTION

The object of the invention is thus to provide a method for controlling at least two of the physical properties, decisive for the quality of the finished smokable article, of a material rod for the production of smokable articles, in particular a tobacco rod or a rod of filter material, in which the afore-mentioned problems are obviated.

In particular, a method is to be proposed with which deviations from the normal operating state, i.e. in particular when starting up but also when predetermined events occur, can again be rapidly and smoothly adjusted to the optimum operational state. Predetermined events may include: breakdowns, mixture change, exceeding predetermined limit values.

The invention therefore proposes a method for controlling at least two of the physical properties, decisive for the quality of the finished smokable article, of a material rod of filter or tobacco material for the manufacture of smokable articles, in particular in filter or cigarette manufacture, in which the actual values of said properties are detected, the particular differences between the actual values and the associated desired values are determined, and from the determined differences control signals are obtained for actuating elements influencing the mass of the smokable material making up the rod, the improvement being that during the start-up or on occurrence of predetermined events the control is performed by means of only one single primary product parameter, for said primary product parameter the associated actual values for at least one other secondary product parameter are detected and at least one of said actual values is used after calculation and evaluation as desired value for the then switched-on or added control by means of said secondary product parameter.

Expedient embodiments are defined by the features of the subsidiary claims.

The advantages which are achieved with the invention are based on the following considerations: For starting up the production process, but also on occurrence of specific events, only one of the primary product parameters is used as controlled variable; for a cigarette machine this will usually be the weight or diameter signal because these are quantities which are easy to calibrate.

Once the production process has reached the corresponding desired value, i.e. either for the weight/density or for the diameter, the other essential secondary product parameters mentioned above, in particular the hardness and/or the draw resistance, have a predetermined actual value which is detected by means of the associated sensor and after comparison and evaluation are used as reference or desired value for the further control. The hitherto usual complicated recalibrations of the corresponding product parameters one every change of the distrubing influences and the corresponding recovery of an absolute measured value is thus no longer necessary because it has been found that within the tolerance ranges of such a production process the actual value for the draw resistance and/or the hardness arising after adjustment to the optimum density or the optimum diameter leads to a more satisfactory control of the production parameters.

If the machine is driven with a variable speed of rotation, the corresponding product parameters, for example draw resistance and/or hardness, can be corrected by a correction amount which is easy to measure and depends on the speed of rotation of the machine. Moisture correction is also possible without any problems.

To operate with greater statistical accuracy when determining the respective desired value, the relative new desired value is determined after a predetermined cycle via a mathematical function, in particular by forming the average value, i.e. the particular actual value for the draw resistance and/or the hardness is sensed, for example, every second and after 60 sensings, i.e. once a minute, an average value is formed which is then used as desired value for the further control.

The product parameters draw resistance and hardness can either be controlled separately or in combination by means of an autoselector circuit as described in the prior patent application P 36 13 957.2-23. Alternatively, the control signals can be determined via mathematical connection for example by forming the average value or linear combinations.

The particular desired value which depends on the actual mixture, the machine setting and the environmental influences can be entered either individually for each product parameter or as combination by gating the particular actual values together. The corresponding adjustments are made very rapidly so that, for example, when starting up a machine the desired value of the primary product parameter is reached within a few seconds, i.e. the diameter or the density weight and then after about 2 minutes the further control can be started as desired value with the actual values determined for the secondary product parameters, that is hardness, draw resistance and/or diameter.

The recalculation of the relative desired value for the secondary product parameters draw resistance, hardness and diameter can take place both at external and internal events; external events include in particular material change or the stop of the machine, involving restarting of the machine, whilst an internal event is a violation of the limit value of the primary or secondary product parameters in question. It may, for example, be defined that on deviation of the secondary product parameter draw resistance and/or hardness by more than $\pm 10\%$ from the given relative desired value, a recalculation is carried out; such a recalculation can also be carried out on a corresponding change of the primary product parameter, in a cigarette machine the weight/density or the diameter.

This desired value determination can be employed in cigarette manufacturing machines but also in filter manufacturing machines and here again the appropriate product parameters can be measured, in particular weight/density or diameter, and draw resistance.

BRIEF DESCRIPTION OF THE DRAWINGS

The invention will be explained hereinafter with the aid of examples of embodiment with reference to the attached schematic drawings, wherein.

DESCRIPTION OF THE PREFERRED EMBODIMENTS

Figure 1:
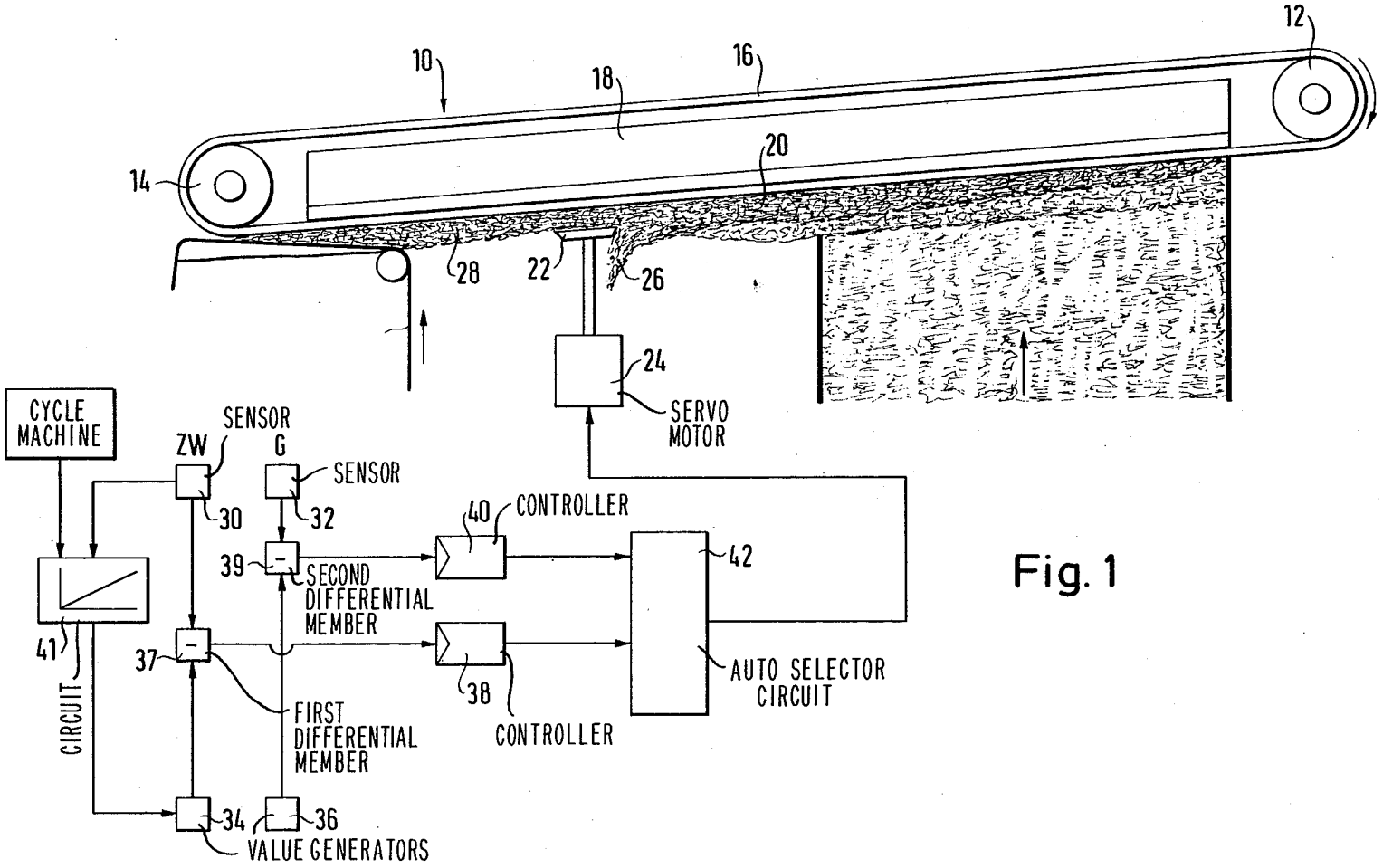
FIG. 1 shows the basic construction of a control apparatus for the weight and the draw resistance of the tobacco rod in cigarette manufacture and FIG. 2 is another view of a control apparatus for the hardness, the draw resistance and the weight of a tobacco rod in cigarette manufacture.

The rod producing machine indicating in FIG. 1 generally by the reference numeral 10 comprises two rotatably mounted rollers 12 and 14, at least one of which is driven. Over the two rollers 12 and 14, a perforated belt 16 runs which serves as conveying means. Between the two runs of the belt 16 a partial vacuum chamber 18 is arranged.

The tobacco brought up from below in the direction of the arrow is sucked by the partial vacuum onto the belt 16 rotating in the direction of the arrow and entrained so that a tobacco layer 20 forms on the belt 16. For setting a tobacco layer 20 of predetermined density an "equalizer" is used, i.e. trimmer discs 22, which in accordance with the illustration of FIG. 1 can be displaced in vertical direction via a servo motor 24. The excess tobacco cut off by the trimmer discs 22 is denoted by the reference numeral 26.

This provides on the belt 16 an equalized tobacco layer of predetermined height which is denoted by the reference numeral 28 and is brought by means of a format finger to rod shape and is enclosed by the cigarette paper.

At the tobacco rod and the finished cigarette cut to the particular length at least two different types of physical properties are measured, namely a primary product parameter and a secondary product parameter. Possible primary product parameters are the weight/density or the diameter of the tobacco rod or the finished cigarette. Possible secondary product parameters are the draw resistance and/or the hardness and/or the diameter of the tobacco rod or finished cigarette.

Hereinafter this embodiment will be described for the case in which the weight G is used as primary product parameter, and as secondary product parameter, the draw resistance ZW. The corresponding actual values are supplied by a sensor 30 for the draw resistance ZW and a sensor 32 for the weight G together with the associated desired values from reference-value generators 34 and 36 respectively to a first differential member 37 for the draw resistance ZW and a second differential member 39 for the weight G. The differential signals from the two differential members 37, 39 are supplied to associated controllers 38, 40 which form corresponding control signals, generally in accordance with a predetermined control characteristic.

The two control signals are supplied to an autoselector circuit 42 which determines the largest of the control signals and drives the servo motor 24 for the trimmer discs 22 by means of this largest control signal.

In normal operation the position of the trimer discs 22 is set in accordance with the draw resistance ZW, i.e. the draw resistance controller 38 controls the rod production.

If, however, the weight G increases too much, the end product cigarette no longer corresponds to the predefined parameters so that when the output signal of the controller 40 becomes too large said controller 40 takes over the control of the trimer discs 22, i.e. in this case the autoselector circuit 42 selects the output signal of the controller and uses this control signal, which depends on the measured weight G, for setting the trimmer discs 22.

Now, slight deviations in the draw resistance ZW necessarily occur. These can, however, be accepted compared with the excessive fluctuations of the weight G.

In such a case, caused for example by the action of disturbing parameters, in particular by inhomogeneous cut tobacco, the actual controlled parameter, i.e. the draw resistance ZW, remains uncontrolled until the conditions in the rod formation permit restarting of normal operation. This restarting is also effected automatically and smoothly in a similar manner as in the change from the draw resistance control to the weight control.

When the disturbances have died away, for example the inhomogeneous condition of the cut tobacco (tobacco fleece), the controller 38 for the draw resistance ZW takes over the setting of the trimmer discs 22.

When starting the rod-producing machine 10 the following control is adopted: The trimmer discs 22 are brought into the drive position; when reaching a predetermined speed of rotation, for example a speed of 1200 rpm, the weight density control is switched on, whilst the draw resistance control remains switched off. The actual values for the pressure as relative indication of the draw resistance increase and finally reach the lower limit value of a generally variable tolerance range, the "good" range; the actual desired values are determined after calculation and evaluation. The speed and/or moisture compensation can now be set in operation.

The sensing of the actual values for the draw resistance ZW corresponds to a predetermined cycle so that, for example within 2 minutes, 120 draw resistance values are detected and a corresponding average value is formed.

This mean value of the actual values of the draw resistance ZW is formed in a corresponding circuit 41 which receives a clock signal derived, for example, from the machine cycle and supplies this signal to the memory of the desired value generator 34. As a rule the stored, old desired value is written over.

The control is now switched from the weight control to the draw resistance control, using, as the desired value, the mean value determined of the actual values of the draw resistance ZW.

If, in a subsequent operative, a breakdown occurs so that the actual values leave the tolerance range explained above, i.e. for example have a value which differs by more than ±10% from the desired value, a switchover is effected to the weight control, and the draw-resistance control is switched off. When the draw resistance control signal again reaches the tolerance range, the aforementioned average value calculation starts again with subsequent overwriting of the desired vlaue obtained into the memory of the desired value generator 34, whereafter the draw resistance control is switched on.

Of course, a modification is also possible in which the operation is with weight control only, i.e. the draw resistance control remains switched off as is expedient for specific uses.

The control circuit in operation and the associated adjusting signal can be displayed on a central control panel.

Figure 2:
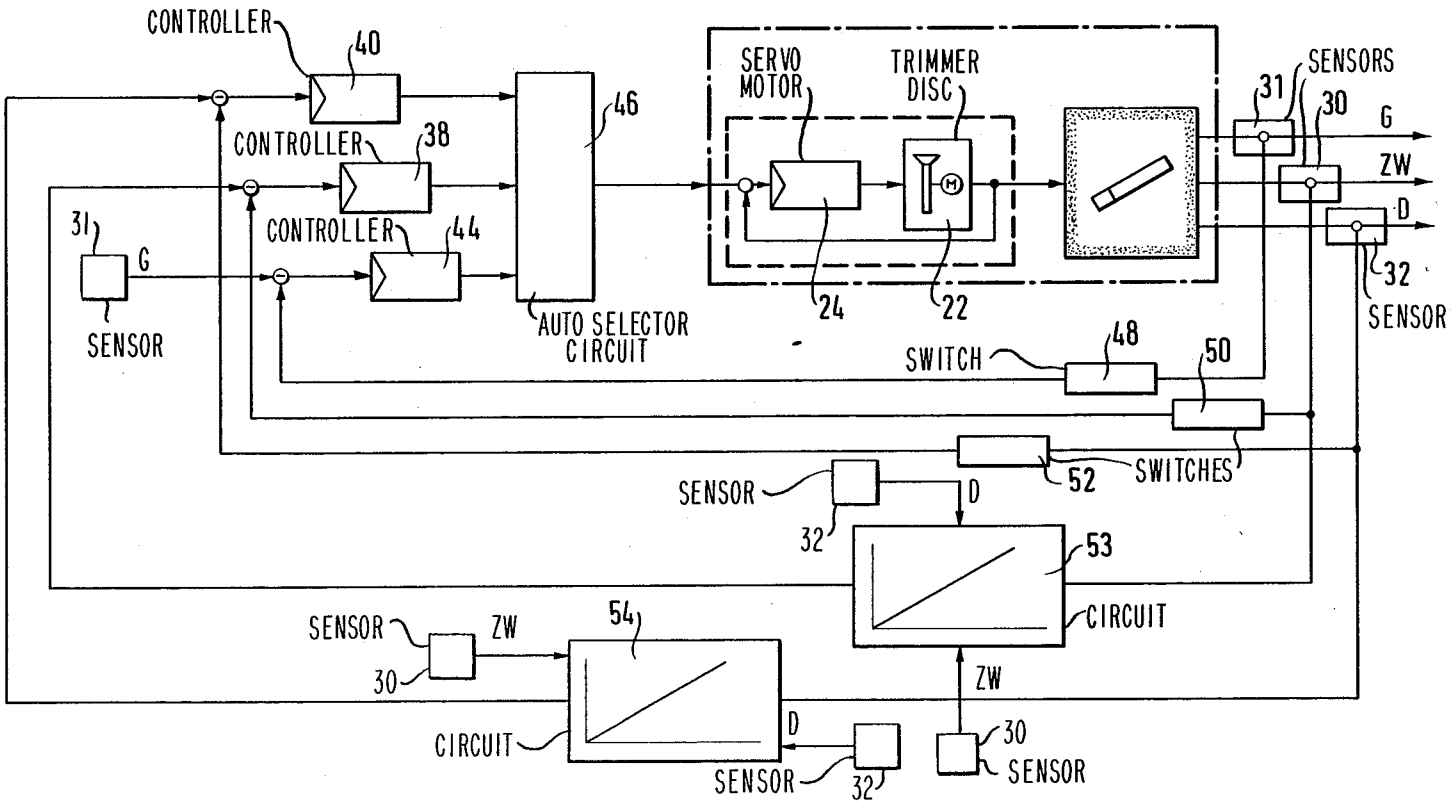

FIG. 2 shows in a different method of illustration an embodiment with three controlled parameters, i.e. apart from the control of the weight G and the draw resistance ZW a control of the hardness or deformation D is additionally carried out. The gating of the three control paths to the controllers 38, 40 and 44 is via an autoselector circuit 46 or via a mathematical combination of at least two of these measured quantities, for example average value formation, which drives the servo motor 24 for the equalizer, i.e. the trimmer discs 22. This figure also shows the formating and glueing with the subsequent sensors 30, 31 and 32 for the weight G, the draw resistance ZW and the hardness/deformation D of the tobacco rod or finished cigarette.

In the lines which supply the actual values for the weight, draw resistance and hardness from the sensors 30, 31 and 32 to the respective controller 38, 40 and 44, there are limit-value switches 48, 50 and 52 which compare in a manner known per se the particular actual value with a predetermined limit value; when one of these limit values is exceeded the switches 48, 50, 52 generate an ejection signal, i.e. the corresponding cigarettes are ejected.

In this case as well, during the starting of the rod-producing machine, and also, however, in the event of a breakdown, the actual values of the sensor 30 for the draw resistance ZW and the sensor 32 for the hardness or deformation D are supplied via circuits 53 and 54 to the control circuits as desired values for the corresponding controlled parameters. The circuits 53, 54, formed in the manner already discussed, clock average values from the particular sensed actual values and also permit a further correction, for example a rotary speed and/or moisture correction, of said desired values.

Hitherto only embodiments have been described in which by means of the autoselector circuits 42 and 46 the particular instantaneously largest control signal is used for the control.

It is alternatively possible to dispense with the autoselector circuit 42, 46 and for example to operate during the starting only with weight control, switching however to draw resistance and/or hardness control after the starting. In this case the weight control thus serves only for the starting and the simultaneous determination of a suitable desired value for the subsequent draw resistance or hardness control.

It is also possible, as alternative to the above-described embodiments, to use as primary product parameter not the weight but the diameter of the tobacco rod or finished cigarette, in which case an appropriate sensor must be provided as described for example in the prior German Offenlegungsschrift No. 36 07 244. Then, in a manner similar to that already described for the starting or in the event of a breakdown only the diameter control is in operation; when a kind of equilibrium state is reached, a switchover is made to another control, possibly also by means of an autoselector circuit.

Finally, however, the diameter can also be used as secondary product parameter, i.e. in such a case the weight would be used as primary product parameter so that after the starting the weight control takes place in conjunction with the diameter and/or draw resistance and/or hardness control.

While the invention has been particularly shown and described in reference to preferred embodiments thereof, it will be understood by those skilled in the art that changes in form and details may be made therein without departing from the spirit and scope of the invention.

We claim:

1. A method for controlling at least two physical properties, decisive for the quality of the finished smokable article, of a material rod for the manufacture of smokable articles, comprising the step of:

(a) detecting actual values of said properties;

(b) determining respective differences between said actual values and the associated desired values; and (c) obtaining, from determined differences, control signal for actuating elements influencing the mass of the smokable material making up the rod, wherein (d) during an occurrence of predetermined events, control is by means of a single primary product parameter, (e) for said primary product parameter, the associated actual values are detected for at least one other secondary product parameter and (f) using at least one of said actual values after said steps of detecting, determining and obtaining as desired value for a switched on and an additional control by means of said secondary product parameter.

2. A method according to claim 1, wherein as primary product parameter at least one of the weight of the material rod and the diameter thereof is used.

3. A method according to claim 1, wherein as secondary product parameter at least one of the hardness, the draw resistance and the diameter of the material rod is used.

4. A method according to claim 1, wherein after reaching the desired value after said steps of detecting, determining and obtaining for the primary product parameter, a plurality of actual values of at least one secondary product parameter is detected and a corresponding average value is formed which is then used as desired value for said control.

5. A method according to claim 1, wherein on reaching the desired value after said steps of detecting, determining and obtaining of the primary product parameter, at least one further control with a secondary product parameter is added.

* * * * *